US007899720B1

(12) United States Patent
Nesladek

(10) Patent No.: US 7,899,720 B1
(45) Date of Patent: Mar. 1, 2011

(54) METHOD AND APPARATUS FOR MANAGING ALERTS

(75) Inventor: Christopher D. Nesladek, San Francisco, CA (US)

(73) Assignee: Intuit Inc., Mountain View, CA (US)

( * ) Notice: Subject to any disclaimer, the term of this patent is extended or adjusted under 35 U.S.C. 154(b) by 1283 days.

(21) Appl. No.: 11/262,218

(22) Filed: Oct. 27, 2005

(51) Int. Cl.
*G07F 19/00* (2006.01)
*G08B 23/00* (2006.01)

(52) U.S. Cl. ..... 705/34; 340/500; 340/517

(58) Field of Classification Search ..... 705/34; 340/500, 517
See application file for complete search history.

(56) References Cited

U.S. PATENT DOCUMENTS 6,934,691 B1 * 8/2005 Simpson et al. ..... 705/34
7,259,666 B1 * 8/2007 Hermsmeyer et al. ..... 340/517
2001/0012346 A1 * 8/2001 Terry ..... 379/112.01
2005/0177480 A1 * 8/2005 Huang ..... 705/34
2005/0187805 A1 * 8/2005 English ..... 705/8
2005/0253701 A1 * 11/2005 Parello et al. ..... 340/517
2007/0038563 A1 * 2/2007 Ryzerski ..... 705/40

OTHER PUBLICATIONS

Wolfe, Daniel. Security, marketing among new applications for online alerts. American Banker, v 170, n. 168, p. 1. Aug. 31, 2005.*
www.ambientdevices.com, Ambient Devices, as located on website Oct. 4, 2001.

* cited by examiner

*Primary Examiner*—Matthew S Gart
*Assistant Examiner*—Scott A Zare
(74) *Attorney, Agent, or Firm*—Osha • Liang LLP

(57) ABSTRACT

A method and apparatus for managing alerts is described, the method including receiving consumer financial data including at least one financial deadline. Alert level criteria is applied to the data in order to determine an alert level for each of the deadlines. A visual or audible alert indicator is activated which corresponds with at least one alert level. Alert level criteria is periodically reapplied to determine an alert level for each of the deadlines.

14 Claims, 3 Drawing Sheets

METHOD AND APPARATUS FOR MANAGING ALERTS

BACKGROUND

Fiscal awareness and financial planning has existed for many years. Modern-day households receive bills on a regular basis from a number of service providers, and debt servicing agencies such as credit card companies, mortgage companies, etc. These bills typically arrive at different times during the month, because they are associated with different business entity's providing services and goods to the household. Typically associated with each bill is a payment deadline and a minimum payment amount due.

In addition to bills receipt for goods and services provided to the household, it is common for a household to experience other important financial deadlines such as dates to file tax returns and pay taxes owed, expiration dates for stock options, appointment dates for medical purposes, etc., and other deadlines.

To ensure that deadlines are not missed, people often pay their bills as those bills arrive, or alternatively pay them at one or more particular predesignated time periods during the month, such as on the 15th or 30th day of the month. Sometimes people and businesses put critical data relating to financial obligations in their calendars. Other people and businesses put those critical dates into a computer system and periodically check that computer system against a calendar in order to make sure that issues associated with the deadline are attended to in a timely manner.

SUMMARY

A method and apparatus for managing alerts is described, the method including receiving consumer financial data including at least one financial deadline. Alert level criteria is applied to the data in order to determine an alert level for each of the deadlines. A visual or audible alert indicator is activated which corresponds with at least one alert level. Alert level criteria is periodically reapplied to determine an alert level for each of the deadlines.

The consumer financial data includes at least one data type selected from the group consisting of stock data, banking data, bill pay data, tax data, reimbursement data. The alert level criteria includes a category and a threshold, wherein the category is one selected from the group consisting of a payment due date, a minimum balance requirement, a minimum payment due, an expiration date. The threshold is at least one selected from the group consisting of a number of days, an amount, and a percentage.

The apparatus includes an input/output manager for exchanging consumer financial information with external devices, and a data storage area for storing the consumer financial information received through the input/output manager, wherein the consumer financial information includes at least one financial deadline. At least one of a visual or audible alert indicator is provided for indicating a first alert level of a plurality of alert levels, and is managed by an alert manager. The alert manager uses alert level criteria to associate each of the at least one deadlines with an alert level, and an indicator manager for activating the alert indicator if at least one deadline is associated with the first alert level.

Other aspects of the invention will be apparent from the following description and the appended claims.

DETAILED DESCRIPTION

Figure 1:
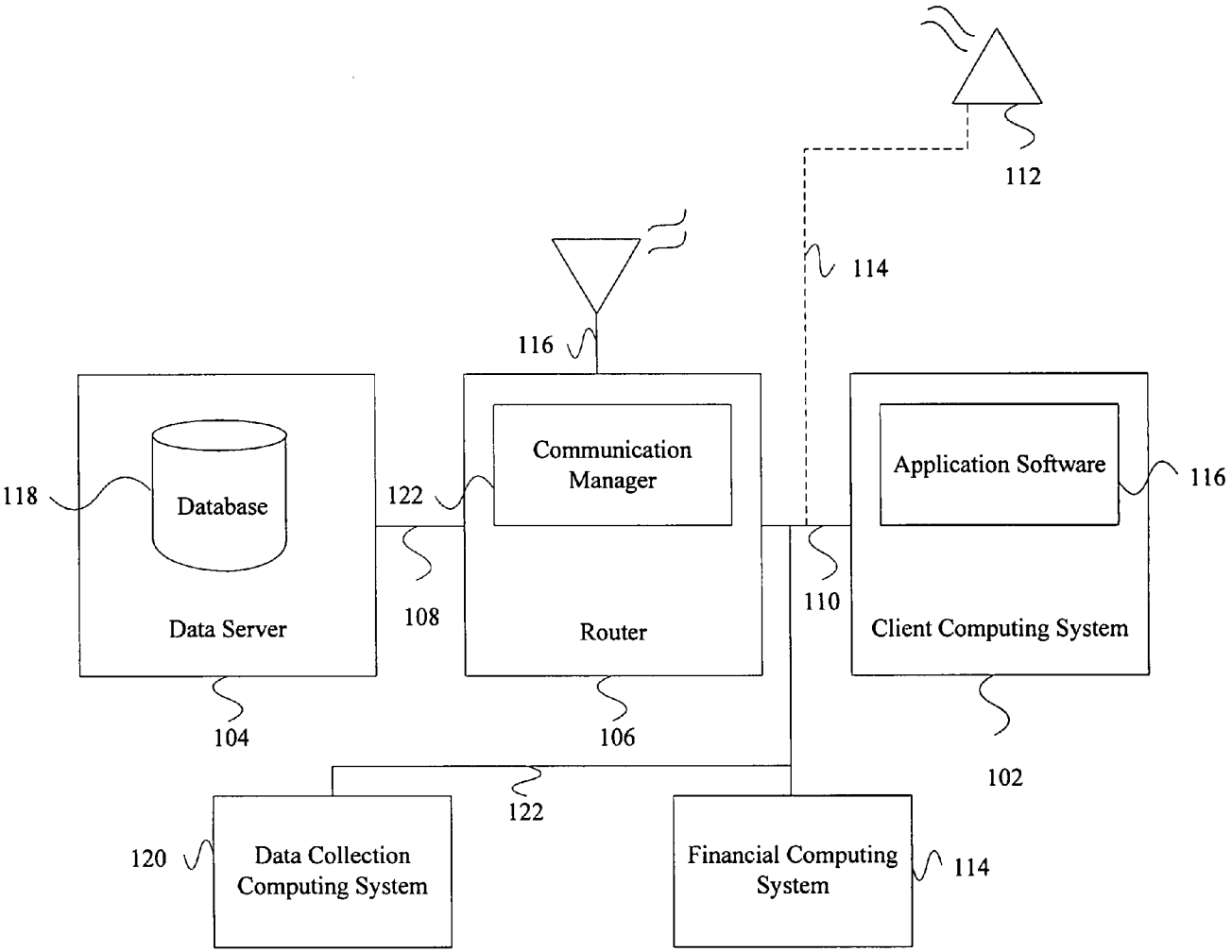
FIGS. 1 and 2 show block diagrams according to one or more embodiments of the invention.

Exemplary embodiments of the invention will be described with reference to the accompanying drawings. Like items in the drawings are shown with the same reference numbers.

In an embodiment of the invention, numerous specific details are set forth in order to provide a more thorough understanding of the invention. However, it will be apparent to one of ordinary skill in the art that the invention may be practiced without these specific details. In other instances, well-known features have not been described in detail to avoid overcomplicating this disclosure.

In this specification, it is intended that the term "coupled" describe devices which interact with each other, directly or indirectly. For example, first and second devices that interact with each other through a transmission line between the two devices are directly coupled. Further, first and second devices that have intermediate devices disposed between them, and interact with one another through those intermediate devices, are indirectly coupled. In both situations, the first and second devices are considered coupled.

In general, embodiments of the invention relate to a method and apparatus for managing alerts. More particularly, in one or more embodiments, a method and an apparatus for managing alerts are described, including receiving data having one or more deadlines, applying alert level criteria to determine an alert level to be associated with each deadline, and activating an alert indicator, as needed, based on whether one or more deadlines meet criteria associated with an alert level that a given alert indicator represents.

In one aspect of the invention, a remote alert management device is placed at a strategic location where audible or visual indicators will be noticed. At appropriate times determined by system design or through user or administrator configuration, deadline information is exchanged between the remote alert management device and a data repository having deadline information stored therein. At some time period after the deadline information is exchanged, the deadline information is evaluated against alert level criteria such as date thresholds, payment amount thresholds, and other criteria in order to determine an alert level associated with one or more deadlines present within the deadline information.

Alert levels may include, but are not limited to, a lowest level of alert requiring no attention, a middle level of alert representing some degree of attention, and a highest level of alert requiring immediate action. A system implementing the invention may have fewer or more alert levels, and does not necessarily need to have the same number of alert levels and alert indicators.

In one or more embodiments of the invention, one or more alert indicators are associated with one or more alert levels. For example, in a system having the three alert levels just described, there may be one or more alert indicators, such as a yellow indicator assigned to a middle level of alert, and a red indicator assigned to a highest level of alert. Also associated with one or more alert levels is an optional audible indicator.

Once an alert level has been determined for each of the deadlines within the deadline information, a determination is made as to the highest level of alert that is presently associated with the one or more deadlines. That highest level of alert may then be reflected either visually or audibly using an appropriate alert indicator.

Deadlines come in many areas of life, and may relate to medical and dental appointments, financial deadlines such as when needing to pay a bill, deposit funds into a bank account, buy or sell stock or stock options, tax related data such as when a tax return is due, when a tax payment is due, when a tax refund is expected, etc.

In order to track more than just a few deadlines to ensure that one or more deadlines do not pass without action taken to satisfy the related requirement associated with the deadline, an alert management system is presented which provides notification to a user that one or more deadlines meet preestablished criteria indicating that a certain level of attention should be paid to the deadline.

FIG. 1 is a block diagram according to one or more embodiments of the invention. Client computing system 102 is coupled to data server 104 through router 106 over transmission lines 108 and 110. Also coupled to computing system 102, data server 104, and router 106 are an alert device 112 and optional financial computing system 114. Coupling to alert device 112 is accomplished through optional transmission line 114 or wireless means 116. Wireless means 116 may include, but is not limited to, radio frequency, optical, infrared, or other wireless devices, etc. Persons of ordinary skill in the art having the benefit of this disclosure will readily be aware of various ways to couple alert device 112 to other devices while still remaining within the scope and purpose of the invention.

In one embodiment of the invention, financial information is provided to client computing system 102 by financial computing system 112. At least a portion of that financial information contains one or more deadlines regarding one or more actions that need to take place. Financial computing system 112 may belong to a financial institution such as a bank, a stock brokerage firm, a bill issuing entity such as a business, a governmental agency, etc. The one or more deadlines may include, but are not limited to, payment deadlines for bills, stock option expiration dates, minimum balance requirements, stock for stock option purchased dates, employment benefit deadlines, etc.

Optionally the financial information may alternatively be provided to data server 104 with at least a portion of the financial information being stored within database 118. Optionally, application software 116 executes on client computing system 102 and manages the exchange of the financial information between financial computing system 112 and either of client computing system 102 and data server 104.

In addition to or alternative to financial computing system 114, data collection computing system 120 may be present in the system and coupled to financial computing system 114, client computing system 102, etc., through transmission lines 122. Data collection computing system 120 is intended to represent a generic computing that tracks one or more of medical appointments, car appointments, education appointments, such as when schools are open or closed according to their calendars, etc. As with financial computing system 114, deadline related information may be exchanged between data collection computing system 120 and either of client computing system 122 and data server 104 as necessary.

Router 106 includes communication manager 122 for facilitating communication between one or more devices such as client computing system 122, data server 104, and alert device 112. Data collection computing system 120 and financial computing system 114 are optional, but may be present if it is desired that client computing system 102 retrieve data from one or more external sources such as financial computing system 114 and data collection computing system 120. In one or more embodiments of the invention, application software 116 incorporates functionality enabling a user of client computing system 102 to manually enter financial, medical, personal, or other deadlines, if desired.

In one or more embodiments of the invention of alert device 112 receives a portion of financial information from either client computing system 102 data server 104 are directly from financial computing system 114 or data collection computing system 120. The portion of financial information received by alert device 112 includes one or more deadlines or other information to which a threshold may be applied in order to determine one or more alert levels for one or more portions of the financial information.

As previously discussed, alert device 112 receives the one or more portions of the information containing deadlines or other criteria through wireless means or through transmission lines 114.

Alert device 112 contains one or more modules to process the deadlines and or other criteria in order to determine one or more alert levels.

Figure 2:
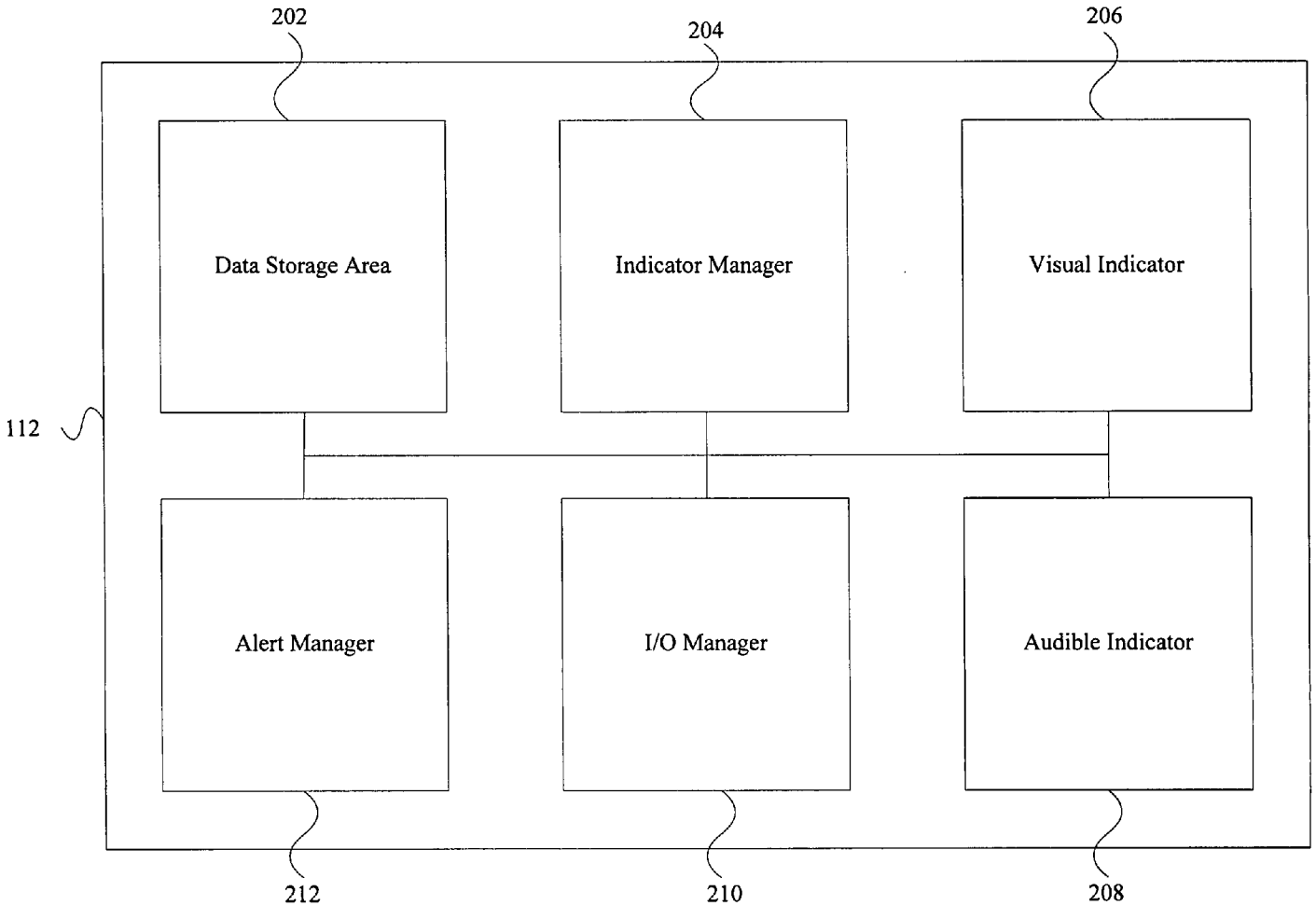

FIG. 2 shows a block diagram of an alert device according to one or more embodiments of the invention. Alert device 112 includes one or more of data storage area 202, indicator manager 204, visual indicator 206, audible indicator 208, I/O manager 210, and alert manager 212.

Data storage area 202 provides local data storage for one or more deadlines or other alert information which may been received from any of client computing system 102, financial computing system 114, data collection computing system 120, or data server 104.

I/O manager 210 facilitates the exchange of information between alert device 112 and other devices such as financial computing system 114 and client computing system 102.

Alert manager 212 facilitates the evaluation of data stored in data storage area 202 or alternatively received in real-time from financial computing system 114, data collection computing system 120, client computing system 102, or data server 104, and the determination of one or more alert levels corresponding to the information.

Once one or more alert levels have been associated with one or more portions of information received from external sources such as financial computing system 114 or client computing system 102, one or more alert indicators such as visual indicator 206 or audible indicator 208 are optionally activated, in order to alert a user of alert device 112 to the existence of an alert condition that may or may not require attention. Optionally, an alert indicator may be provided which is activated at a lowest alert level not requiring any attention, in order to assure a user that deadlines or other alert-related information do not need attention.

In order to manage alerts, one or more methods are performed by modules within alert device 112.

Figure 3:
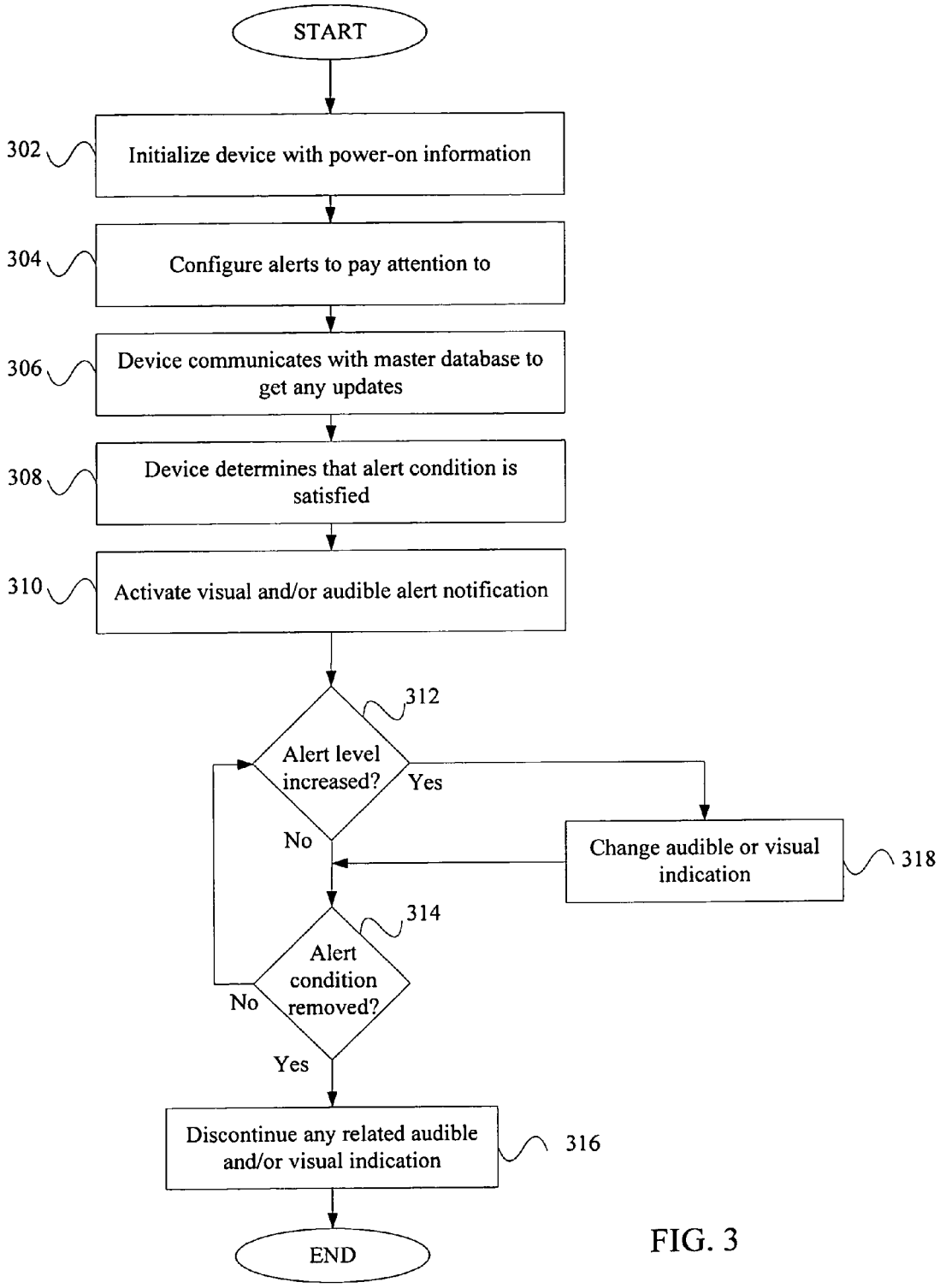
FIG. 3 shows a flow chart according to one or more embodiments of the invention.

FIG. 3 shows a flowchart of a method according to one or more embodiments of the invention. At 302, alert device 112 is powered up and initialized. Initialization optionally includes reading data that may be stored within data storage area 202. Further initialization optionally includes retrieving one or more portions of information having one or more deadlines or other condition requiring attention in the future. Such an information retrieval may take place using one or more external computing systems such as data server 104 or client computing system 102.

At 304, alert device 112 is configured with threshold criteria which will be used later to determine whether one or more portions of that information should trigger one or more alert levels, and thus activate one or more alert indicators. The threshold criteria may include, but is not limited to a number of days prior to an appointment, a number of days prior to a deadline, a minimum bank account balance, and a number of days prior to a tax return deadline.

At 306, alert device 112 optionally communicates with a master database such as database 118 to get updates to the financial or other information containing one or more deadlines or other conditions, and optionally receives and alert criteria updates from one or more external devices, such as client computing system 102.

At 308, a determination is made as to whether any deadlines or other conditions within the alert information are satisfied, and what alert level, if any to assign to one or more portions of that information. In one embodiment of the invention, one or more deadlines are present in the alert information, and at least one of those deadlines satisfy at least one alert criteria.

For example, assuming that a medical appointment was scheduled for Oct. 8, 2005, and the present date is Oct. 7, 2005. If a threshold criteria for a visual alert for a medical appointment category was that the appointment was within 2 calendar days, that criteria is considered satisfied, and the particular appointment event would be associated with the visual alert. It could also be that the same appointment satisfied a higher level alert category necessitating an audible or other type of alert.

In some circumstances, it may be desirable to activate all alerts corresponding to one or more satisfied alert criteria. Alternatively, it may be desirable to activate only the alert indicator corresponding to the highest alert level satisfied by a threshold test. Finally, it may be desirable to activate more than one, but less than all alert indicators corresponding alert levels satisfied by threshold tests.

At 310, assuming that at least one alert criteria is satisfied, a visual or audible indicator is activated which corresponds to the highest level alert criteria that is satisfied, as set forth in the configuration determined at 302.

At 312, after a predetermined time period following the activation of an alert, or after a reexamination of deadlines and other information against alert criteria, a determination is made as to whether one or more alert levels have increased. If no, the method proceeds at 314, where a determination is made as to whether one or more alert conditions have been removed or have decreased, perhaps due to the satisfaction of a deadline, or through other means.

If, at 314, one or more alert conditions have been removed or have decreased, the method proceeds at 316 where any visual, audible or other alert indicators that were activated solely due to the removed or decreased alert condition are deactivated. Thus, if an alert indicator was activated responsive to an alert condition corresponding to the Oct. 8, 2005 medical appt., and that appt time has passed with a satisfaction of the deadline (the appointment occurred, was rescheduled, etc.) that alert indicator is deactivated.

If, at 312, an alert level has increased, perhaps due to the satisfaction of a higher level alert criteria, the method proceeds at 318 when the audible or visual alert if changed to reflect the higher level alert condition. This may mean that the lower and higher level indicators are simultaneously activated, the higher level alert indicator is activated by itself, or another combination, as desired by either a user of the system, or by system designers.

If, at 314, an alert condition was not removed, the method proceeds again at 312.

Advantages which may be seen in systems practicing the invention include a user having confidence that their deadlines are being managed, and that they will be notified according to use-defined criteria if any conditions exist that the user feels require attention.

Computer code implementing the methods presented in this disclosure may be stored in memory within a computer, or alternatively stored in more permanent computer readable media such as flash memory, one or more hard drives, optical disks, compact disks, and magnetic tapes, or any other storage device. Further, such code may be transferred over communications networks with or without a carrier wave.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for managing alerts comprising:

identifying, within a financial computing system (FCS) executing on a processor, a consumer financial data item comprising a financial deadline;

comparing, by the FCS, a number of days between the financial deadline and a current date with a threshold, wherein the number of days satisfies the threshold;

determining, by the FCS, an alert level corresponding to the threshold;

sending, from the FCS to an alert device comprising an alert indicator using an electronic network, the alert level and a portion of the consumer financial data item including the financial deadline, wherein the alert indicator displays the portion on the alert device according to the alert level, and wherein the electronic network couples the FCS and the alert device;

identifying, within the FCS, a minimum payment amount and a minimum balance requirement, wherein the consumer financial data item further comprises the minimum payment amount and the minimum balance requirement;

comparing, by the FCS, the minimum payment amount with a minimum payment amount threshold, wherein the minimum payment amount satisfies the minimum payment amount threshold, and wherein the alert level further corresponds to the minimum payment amount threshold; and sending, from the FCS to the alert device using the electronic network, the minimum payment amount and the minimum balance requirement, wherein the alert indicator further displays the minimum payment amount and the minimum balance requirement on the alert device according to the alert level.

2. The method of claim 1, further comprising:

calculating, by the FCS, a revised number of days until the financial deadline;

comparing, by the FCS, the revised number of days with a second threshold, wherein the revised number of days satisfies the second threshold, and wherein the number of days exceeds the revised number of days;

determining, by the FCS, a higher alert level distinct from the alert level and corresponding to the second threshold; and sending, from the FCS to the alert device using the electronic network, the higher alert level, wherein the alert indicator further displays the portion on the alert device according to the higher alert level.

3. The method of claim 2, wherein the alert indicator displays the portion on the alert device in the color red based on the higher alert level.

4. The method of claim 1, wherein the consumer financial data item further comprises at least one selected from the group consisting of stock data, banking data, bill pay data, tax data, and reimbursement data.

5. The method of claim 1, wherein the alert level further corresponds an expiration date.

6. The method of claim 1, wherein the alert indicator displays the portion on the alert device in the color yellow based on the alert level.

7. The method of claim 1, wherein the FCS is operated by a bill issuing entity.

8. The method of claim 1, wherein the electronic network comprises a wired transmission line connected to both the FCS and the alert device.

9. A computer readable medium storing instructions for managing alerts, the instructions executable on a computer and comprising functionality to:

identify, within a financial computing system (FCS), a consumer financial data item comprising a financial deadline;

compare, by the FCS, a number of days between the financial deadline and a current date with a threshold, wherein the number of days satisfies the threshold;

determine, by the FCS, an alert level corresponding to the threshold;

send, from the FCS to an alert device comprising an alert indicator using an electronic network, the alert level and a portion of the consumer financial data item including the financial deadline, wherein the alert indicator displays the portion on the alert device according to the alert level, and wherein the electronic network couples the FCS and the alert device;

identify, within the FCS, a minimum payment amount and a minimum balance requirement, wherein the consumer financial data item further comprises the minimum payment amount and the minimum balance requirement;

compare, by the FCS, the minimum payment amount with a minimum payment amount threshold, wherein the minimum payment amount satisfies the minimum payment amount threshold, and wherein the alert level further corresponds to the minimum payment amount threshold; and send, from the FCS to the alert device using the electronic network, the minimum payment amount and the minimum balance requirement, wherein the alert indicator further displays the minimum payment amount and the minimum balance requirement on the alert device according to the alert level.

10. The computer readable medium of claim 9, the instructions comprising functionality to:

calculate, by the FCS, a revised number of days until the financial deadline;

compare, by the FCS, the revised number of days with a second threshold, wherein the revised number of days satisfies the second threshold, and wherein the number of days exceeds the revised number of days;

determine, by the FCS, a higher alert level distinct from the alert level and corresponding to the second threshold; and send, from the FCS to the alert device using the electronic network, the higher alert level, wherein the alert indicator further displays the portion on the alert device according to the higher alert level.

11. The computer readable medium of claim 10, wherein the alert indicator displays the portion on the alert device in the color red based on the higher alert level.

12. The computer readable medium of claim 9, wherein the consumer financial data item further comprises at least one selected from the group consisting of stock data, banking data, bill pay data, tax data, and reimbursement data.

13. The computer readable medium of claim 9, wherein the alert level further corresponds to at least one selected from the group consisting of a minimum balance requirement, a minimum payment due, and an expiration date.

14. The computer readable medium of claim 9, wherein the FCS is operated by a bill issuing entity.

* * * * *